US012655987B2

(12) United States Patent
Gillman

(10) Patent No.: US 12,655,987 B2
(45) Date of Patent: Jun. 16, 2026

(54) SAFETY OVEN WITH FAST COOLING SURFACES

(71) Applicant: David Gillman, Laguna Beach, CA (US)

(72) Inventor: David Gillman, Laguna Beach, CA (US)

( * ) Notice: Subject to any disclaimer, the term of this patent is extended or adjusted under 35 U.S.C. 154(b) by 374 days.

(21) Appl. No.: 18/456,177

(22) Filed: Aug. 25, 2023

(65) Prior Publication Data

US 2023/0408106 A1 Dec. 21, 2023

Related U.S. Application Data

(62) Division of application No. 18/153,591, filed on Jan. 12, 2023, now Pat. No. 11,761,639.

(60) Provisional application No. 63/266,749, filed on Jan. 13, 2022.

(51) Int. Cl.

| | |
|---|---|
| ***F24C 15/00*** | (2006.01) |
| ***F24C 3/12*** | (2006.01) |
| ***F24C 7/08*** | (2006.01) |

(52) U.S. Cl.

CPC ..... *F24C 15/006* (2013.01); *F24C 3/128* (2013.01); *F24C 7/085* (2013.01); *F24C 7/087* (2013.01)

(58) Field of Classification Search

CPC ..... F24C 15/006; F24C 3/128; F24C 7/085; F24C 7/087

USPC ..... 126/21 A

See application file for complete search history.

(56) References Cited

U.S. PATENT DOCUMENTS

| | | | | |
|---|---|---|---|---|
| 3,831,578 | A * | 8/1974 | Draper | F24C 15/08 126/273 R |
| 5,237,142 | A * | 8/1993 | Cigarini | G01G 19/56 374/149 |
| 2012/0103966 | A1* | 5/2012 | Gladhill | H05B 1/0263 219/391 |
| 2015/0241069 | A1* | 8/2015 | Brant | F24C 15/006 126/21 A |
| 2017/0108228 | A1* | 4/2017 | Park | F24C 15/024 |

* cited by examiner

*Primary Examiner* — Avinash A Savani

(74) *Attorney, Agent, or Firm* — FisherBroyles, LLP

(57) ABSTRACT

An oven cooling system may include a body having an oven cavity. The system may include a heating element may be operably configured to heat the oven cavity. A door may be coupled to the body and operably configured to open and close. The system may also include an energy bank. Cooling elements may be located in the oven and coupled to the energy bank. The energy bank may be configured to remove heat from the oven cavity to cool the oven.

15 Claims, 4 Drawing Sheets

SAFETY OVEN WITH FAST COOLING SURFACES

RELATED APPLICATIONS

This application is a divisional of U.S. patent application Ser. No. 18/153,591, filed Jan. 12, 2023, which claims the benefit under 35 U.S.C. § 119(e) of U.S. Provisional Patent Application No. 63/266,749, filed Jan. 13, 2022, the disclosures of which are incorporated, in their entirety, by this reference.

BACKGROUND

A burn can be one of the most painful injuries imaginable with potentially life-threatening consequences. Ovens and oven doors are a common cause of burns. Burns in the kitchen, such as those from an oven or oven door, are a hazard for children and adults alike.

Previous attempts at reducing burns from ovens have been less than ideal. Oven mitts and other personal protective equipment used in the kitchen may cover portions of hands and arms but only for those who know they are going to come into contact with hot material and even then, their coverage is not perfect. For example, some potholders and gloves do not cover the forearms and elbows of a user and they only protect the wearer. Children and other people and pets in the kitchen may be unaware of the dangers of an oven or that the oven is open. People and animals that are unaware of the dangers of an oven or that an oven is even open may purposefully or accidentally come into contact with hot surfaces of the oven and burn themselves.

SUMMARY

As will be described in greater detail below, the present disclosure describes various systems and methods for quickly cooling oven surfaces. The present disclosure describes systems and methods for overcoming the above-noted deficiencies. For example, an oven cooling system may include a body having an oven cavity. The system may include a heating element may be operably configured to heat the oven cavity. A door may be coupled to the body and operably configured to open and close. The system may also includes an energy bank. Cooling elements may be located in the oven and coupled to the energy bank. The energy bank may be configured to remove heat from the oven cavity to cool the oven.

INCORPORATION BY REFERENCE

All patents, applications, and publications referred to and identified herein are hereby incorporated by reference in their entirety and shall be considered fully incorporated by reference even though referred to elsewhere in the application.

BRIEF DESCRIPTION OF THE DRAWINGS

A better understanding of the features, advantages and principles of the present disclosure will be obtained by reference to the following detailed description that sets forth illustrative embodiments, and the accompanying drawings of which.

DETAILED DESCRIPTION

The following detailed description and provides a better understanding of the features and advantages of the inventions described in the present disclosure in accordance with the embodiments disclosed herein. Although the detailed description includes many specific embodiments, these are provided by way of example only and should not be construed as limiting the scope of the inventions disclosed herein.

Figure 1:
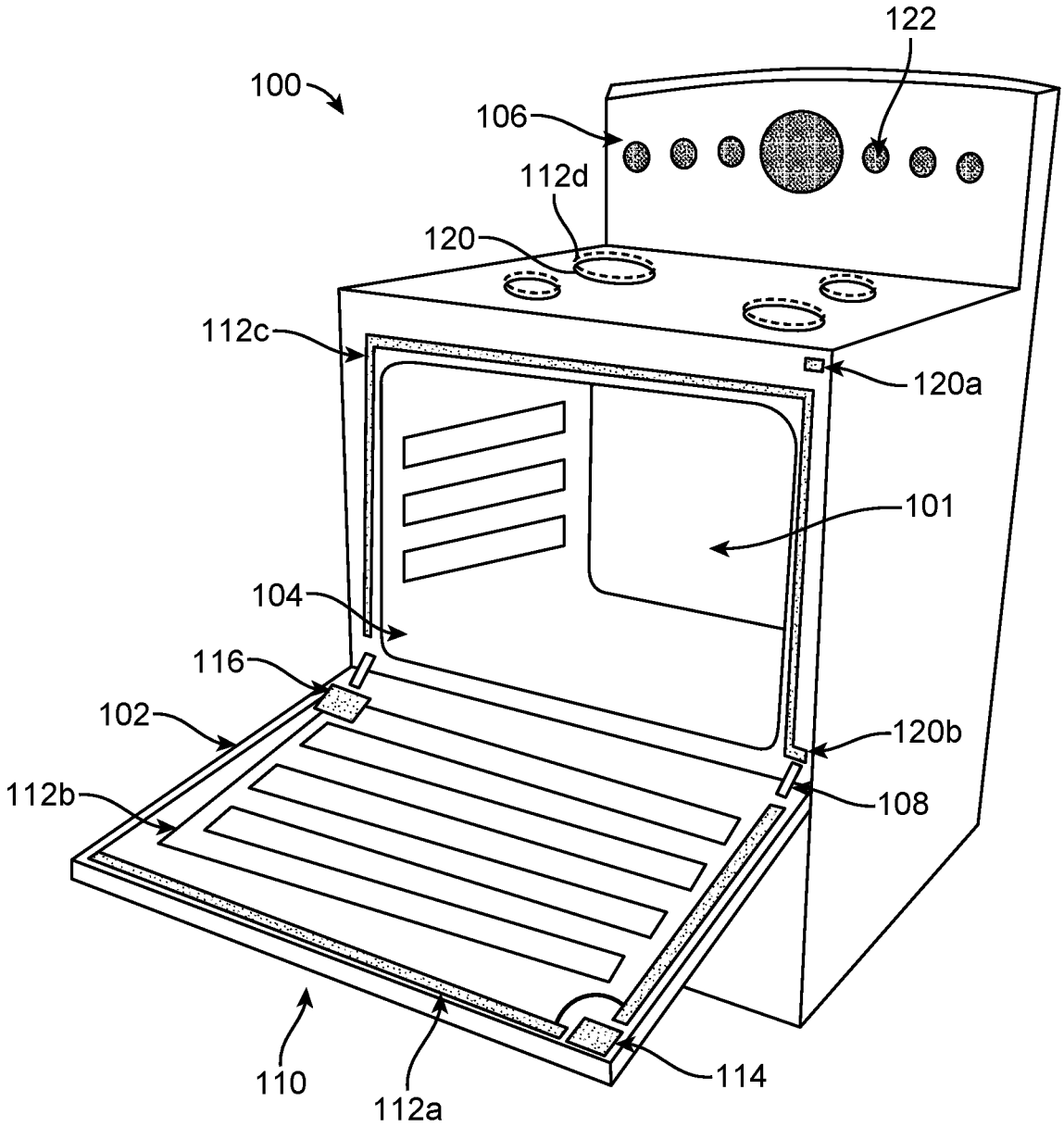
FIG. 1 illustrates an exemplary kitchen range with a safety oven with fast cooling surfaces, in accordance with some embodiments.

FIG. 1 shows an exemplary kitchen range 100 with a safety oven 101 with fast cooling surfaces. The kitchen range 100 includes an oven 101 including an oven door 102, shown in an open position, that provides access to the interior 104 of the oven 101 having a heater 109 for heating the oven. The heater may be an electric heating element, a gas burner, or other heater. The heater may be located within the oven cavity or part of the oven, such as withing a body of the oven, such as in a top, back, bottom, or side wall of the oven. The door 102 is connected to the body of the range 100 via one or more hinges 108. The oven and other features of the range such as a cooktop may be controlled via a user interface 106. The user interface may include one or more input devices, such as knobs, dials, buttons, or other input devices and one or more feedback devices such as a display. The input devices may be used to turn the oven on and off, set the oven temperature, and otherwise control the oven. The display may provide feedback such as the current oven temperature, the oven set point temperature, whether the oven is on and off, and other status indicators relating to the oven and cooktop.

An oven is typically heated to temperatures in excess of 350 degrees Fahrenheit and sometimes in excess of 550 degrees Fahrenheit. The interior surface of the oven may also reach these temperatures. Human skin can burn at temperatures as low as 110 degrees Fahrenheit. At the elevated temperatures found inside an oven, a person may burn their skin after contact with an oven surface for just a small fraction of a second.

The oven 101 includes several features to provide fast cooling of commonly contacted oven surfaces. The cooling system 110 includes a controller 114, sensors 120, the cooling energy bank 116, and coolers 112. The controller 114 which is described in more detail in FIG. 4, may include a processor and memory in may be in electronic communication with one or more sensors 120, the coolers 112, and the energy bank 116. The controller 114 may read information from the sensors 120 and may control the cooling energy bank 116 and coolers 112 based on the information provided by the sensors. The sensors 120 may include position sensors for determining the open or closed status of the door and temperature sensors for determining the temperature of the oven surfaces. The coolers 112 may include one or more devices for removing energy from the surfaces of the oven. For example, coolers 112*b* may be fluid heat exchange circuits that may be embedded in within the surface or may be in contact with the surface such as immediately above or below the oven surface in order to remove heat from the oven surface. In some embodiments, coolers 112*a* may be Peltier coolers that pull energy from the surface of the oven.

The coolers 112 may be electrically or fluidically connected to the cooling energy bank 116. The cooling energy bank 116 may be an energy source or energy sink. In some embodiments, for example with coolers 112 that are fluid heat exchange circuits, the energy bank 116 may be an energy sink. Cool fluid may be stored within the energy bank 116 and upon activation by the controller 114 the cool fluid may be quickly pumped through the cooling circuit 112*b* in order to quickly cool the oven surfaces. The cooling fluid retained within the energy bank 116 and pumped through the cooling circuit 112*b* may be any kind of cooling fluid. Preferably, the cooling fluid is a fluid that is able to quickly receive the energy from the oven door surfaces without changing states such as without boiling, igniting, or smoking, such as an oil with a smoke temperate above a temperature produced or capable of being produced by the oven, such as the oven's highest temperature setting. Being able to quickly remove energy from the surface without boiling or smoking allows the cooling circuit to be maintained at low pressures without having to be designed to handle the higher pressures involved in containing gases that are boiled at high temperatures. In some embodiments, the fluid may be a liquid that removes the heat from the door through the heat of evaporation and may transition from a liquid to a gas as it flows through the cooling circuit 112*b*. The energy removed from the oven door would then be stored in the fluid within the energy bank 116. When the oven door closes the energy stored within the energy bank 116 may be removed, such as by refrigeration or other means.

In some embodiments, the energy bank 116 may store electrical energy that is then used to power Peltier coolers in order to quickly remove heat from the surface of the oven. Peltier coolers work by transferring heat energy from one side of the Peltier device to the other side of the device, based on the direction of current flowing through the device. The electrical energy stored within the energy bank 116 may be quickly transferred to the Peltier coolers upon activation by the controller 114 when the oven door is open. The energy may be stored in capacitors. In some embodiments, the energy bank 116, rather than storing energy, may be a power supply capable of receiving mains power and of providing high current to the Peltier devices to quickly cool the oven surfaces.

In some embodiments, the cooling may be a multistage process. For example, surfaces more likely to be contacted by users may be cooled first at a higher priority and other services less likely to be contacted by users may be cooled second or at a lower priority. For example, corners and edges around the perimeter of the door 102 and the opening of the interior 104, such as indicated by cooling circuits 112*a*, 112*c* may be cooled first while larger services such as the surface of the door may be cooled later or only after the edges have cooled below a specified temperature by cooling circuit 112*b*.

In some embodiments, the cooling circuits 112*a*, 112*b*, 112*c*, although depicted as particular types of cooling devices, may be any of the types of cooling circuits described herein.

In some embodiments, a cooling circuit 112*d* may be used to cool a burner or burners 120. For example, with a glass-top range, a cooling circuit may be located in the cooktop between the burner and the cooking surface of the range or cooktop. The burner may be an electric heating element, an inducting heating element, or other type of burner. The cooling circuit 112*d* may be activated when a burner associated with the cooling circuit is turned off in order to cool the surface of the cooktop and help in preventing burns.

The sensors 120 may include door position sensors and temperature and other types of sensors. Door position sensors may include accelerometers, gyroscopes, switches, and other types of sensors. Accelerometers may measure the rate at which the door is opened and changes in the door position. Gyroscopes may measure the orientation and angular velocity of the door. Switches such as limit switches, contact switches, and proximity sensors may be used to determine whether the door is open or closed. Hall effect sensors may also be used to determine the position of the door. Angle sensors such as angular encoders or variable resistors may be used to determine whether or not the doors open and the angle at which the door has been opened. The door position sensors may be located in the door, in the oven body, or in the hinges.

Temperature sensors may be located in or on the surfaces of the door and the interior of the oven. Temperature sensors may be used to determine whether the oven is on or off and whether the oven or oven surfaces are above or below particular temperature threshold.

Figure 2:
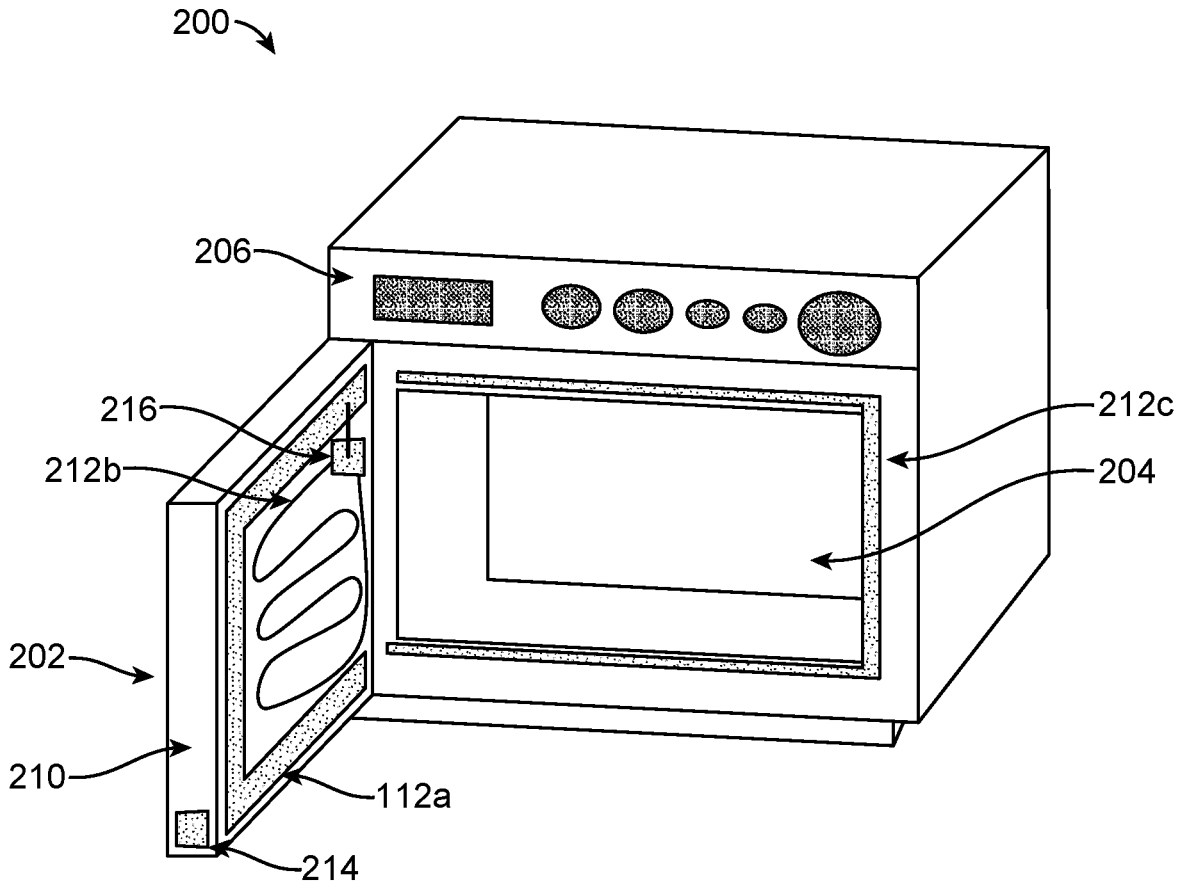
FIG. 2 shows an exemplary safety oven with fast cooling surfaces, in accordance with embodiments.

FIG. 2 shows an exemplary built-in oven 200 with fast cooling surfaces. The oven 210 includes an oven door 202, shown in an open position, that provides access to the interior 204 of the oven 200. The door 202 is connected to the oven 200 via one or more hinges. The oven may be controlled via a user interface 106. The user interface may include one or more input devices, such as knobs, dials, buttons, or other input devices and one or more feedback devices such as a display. The input devices may be used to turn the oven on and off, set the oven temperature, and otherwise control the oven. The display may provide feedback such as the current oven temperature, the oven set point temperature, whether the oven is on or off, and other status indicators relating to the oven.

In some embodiments, the user interface may include an input, such a switch 122, that, when manipulated by a user, can manually activate one or more of the cooling elements 112. In some embodiments, the cooling circuits may be activated based on expiration of a cooking timer or when the oven is turned off. The cooling circuits may be activated with the door closed.

The oven 200 includes several features to provide fast cooling of commonly contacted oven surfaces. The cooling system 210 includes a controller 214, sensors 220, the cooling energy bank 216, and coolers 212. The controller 214 which is described in more detail in FIG. 4, may include a processor and memory and may be in electronic communication with one or more sensors 220, the coolers 212, and the energy bank 216. The controller 214 may read information from the sensors 220 and may control the cooling energy bank 216 and coolers 212 based on the information provided by the sensors. The sensors 220 may include position sensors for determining the open or closed status of the door and temperature sensors for determining the temperature of the oven surfaces. The coolers 212 may include one or more devices for removing energy from the surfaces of the oven. For example, coolers 212*b* may be fluid heat exchange circuits that may be embedded in within the surface or may be in contact with the surface such as immediately above or below the oven surface in order to remove heat from the oven surface. In some embodiments, coolers 212*a* may be Peltier coolers that pull energy from the surface of the oven.

The coolers 212 may be electrically or fluidically connected to the cooling energy bank 216. The cooling energy bank 216 may be a source energy source or energy sink. In some embodiments, for example with coolers 212 that are fluid heat exchange circuits, the energy bank 216 may be in energy sink. Cool fluid may be stored within the energy bank 216 and upon activation by the controller 214 the cool fluid may be quickly pumped through the cooling circuit 212*b* in order to quickly cool the oven surfaces. The cooling fluid retained within the energy bank 116 and pumped through the cooling circuit 212*b* may be any kind of cooling fluid. Preferably, the cooling fluid is a fluid that is able to quickly receive the energy from the oven door surfaces without changing states such as without boiling, igniting, or smoking, such as an oil with a smoke temperate above a temperature produced or capable of being produced by the oven, such as the oven's highest temperature setting. Being able to quickly remove energy from the surface without boiling or smoking allows the cooling circuit to be maintained at low pressures without having to be designed to handle the higher pressures involved in containing gases that are boiled at high temperatures. In some embodiments, the fluid may be a liquid that removes the heat from the door through the heat of evaporation and may transition from a liquid to a gas as it flows through the cooling circuit 212*b*. The energy removed from the oven door would then be stored in the fluid within the energy bank 216. When the oven door closes the energy stored within the energy bank 216 may be removed, such as by refrigeration or other means.

In some embodiments, the energy bank 216 may store electrical energy that is then used to power Peltier coolers in order to quickly remove heat from the surface of the oven. Peltier coolers work by transferring heat energy from one side of the device to the other side of the device, based on the direction of current flowing through the device. The electrical energy stored within the energy bank 216 may be quickly transferred to the Peltier coolers upon activation by the controller 214 when the oven door is open. The energy may be stored in capacitors. In some embodiments, the energy bank 216 rather than storing energy is a power supply capable of receiving mains power in providing high current to the Peltier devices to quickly cool the oven surfaces.

In some embodiments, the cooling may be a multistage process. For example, surfaces more likely to be contacted by users may be cooled first at a higher priority and other surfaces less likely to be contacted by users may be cooled second or at a lower priority. For example, corners and edges around the perimeter of the door 202 and the opening of the interior 204, such as indicated by cooling circuits 212*a*, 212*c* may be cooled first while larger services such as the surface of the door may be cooled later or only after the edges have cooled below a specified temperature by cooling circuit 212*b*.

In some embodiments, the cooling circuits 212*a*, 212*b*, 212*c*, although depicted as particular types of cooling devices, may be any of the types of cooling circuits described herein.

The sensors 220 may include door position sensors and temperature and other types of sensors. Door position sensors may include accelerometers, gyroscopes, switches, in other types of sensors. Accelerometers may measure the rate at which the door is open and changes in the door position. Gyroscopes may measure the orientation and angular velocity of the door. Switches such as limit switches, contact switches, and proximity sensors may be used to determine whether the door is open or closed. Hall effect sensors may also be used to determine the position of the door. Angle sensors such as angular encoders or variable resistors may be used to determine whether or not the doors open and the angle at which the door has been opened. The door position sensors may be located in the door, in the oven body, or in or as part of the hinges.

Temperature sensors may be located in or on the surfaces of the door and the interior of the oven. Temperature sensors may be used to determine whether the oven is on or off and whether the oven or oven surfaces are above or below particular temperature threshold.

An open may have a door that opens with a hinge or hinges at a bottom location, such as shown in FIG. 1, at a top location, such is opposite that shown in FIG. 1, such as for high mounted ovens, or on one side such as shown in FIG. 2 or on both sides, such as an oven with two doors arranged side-by-side.

Figure 3:
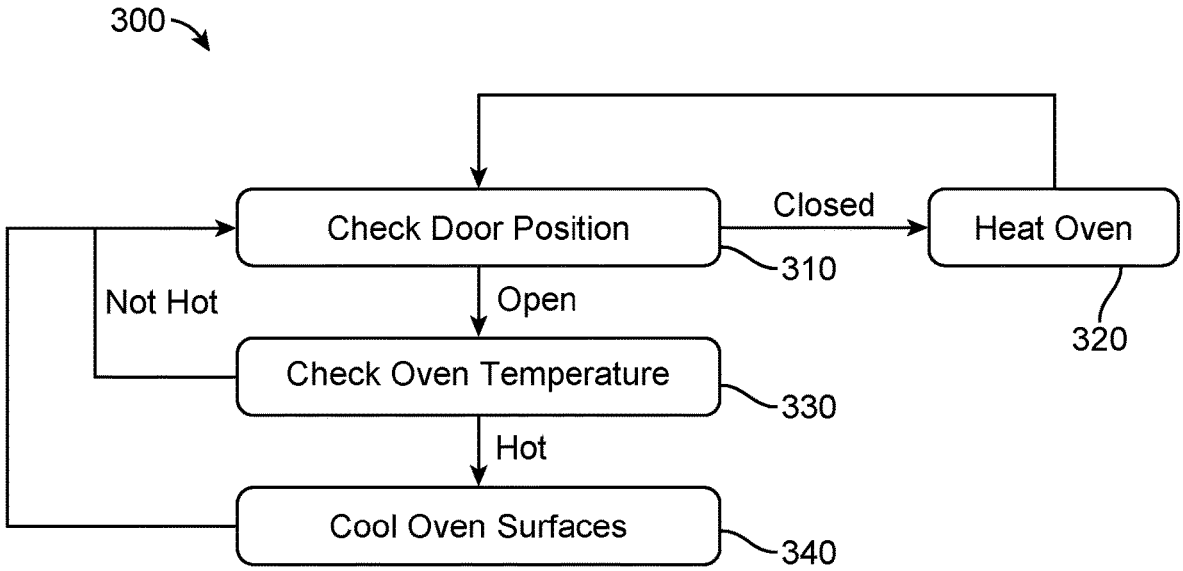
FIG. 3 shows a method for cooling surfaces of a safety oven, in accordance with embodiments.

FIG. 3 shows a method 300 for cooling the surfaces of an oven. The method 300 may be executed using a controller 114, 214 discussed herein. At block 310 the door position is checked, if the doors or doors are closed, the process proceeds to block 320 and the oven continues to heat, and then the process proceeds back to block 310 where the door position is checked again, if the door position is open then the process proceeds to block 330 where the oven temperature is checked. If the oven temperature is not hot or is below a threshold, the method may proceed to block 310. If the oven temperature is hot, such as above a set point, the process proceeds to block 340 for the oven surfaces are cooled.

In more detail, at block 310 the controller may receive or read data from one or more sensors in order to determine the status of the door. For example, in some embodiments the controller may check the status of a switch and, based on the open or close status of the switch, the controller may determine whether or not the door is closed or open. In some embodiments, the controller may read information from an accelerometer to determine that the door moved or is moving and, based on the door movement, determine the door's position and/or whether or not the door is open or closed. In some embodiments, the controller may read information from a gyroscope and determine the orientation or angular velocity of the door to determine whether or not the door moved or is moving and whether or not the door is open or closed. In some embodiments, the controller may read the status of a hall effect sensor, a proximity sensor, or an angle sensor in order to determine whether or not the door is open or closed and or its position. In some embodiments, the controller may use more than one sensor in order to determine the position of the door and whether or not it is open or closed and whether or not to proceed to the next block in the process. For example, the controller may read an input from a limit switch to determine that the door has been moved from the closed position and then may use the angle sensor, accelerometer, hall effect, or other sensor in order to determine the angle or position of the door and how fast the door is moving. In some embodiments, the system may determine that the door position is closed when the limit switch indicates the door is open, but other sensors indicate that the door is opened below a given threshold.

In some embodiments, at block 330, or elsewhere in the method, the status of the oven may be checked. Oven status may include whether the oven is on or off, the temperature setpoint of the oven, and the cooking setting of the oven, such as backing, convention, broiler, etc. In some embodiments, if the oven set to broil, then the method may advance to cool oven surfaces at block 340 when the oven is opened past a certain location or angle. In many ovens, when broiling, the oven door is supposed to be left open a small amount. The oven door may have a detent at which the door is held open a certain amount and cooling may be engaged when or only when the door is opened beyond a particular angle or beyond the detent.

At block 330 the controller may read one or more temperature sensors in order to determine whether the oven and/or the surfaces are hot. For example, in some embodiments, the controller may determine that the oven is hot when a temperature sensor located in or on one of the surfaces of the door or oven is above a threshold. In some embodiments, temperature sensors may be located in one or more positions and may be used to determine how the oven door is cooled. For example, a first sensor may be located at the edges or perimeters of the door and of the oven opening and a second sensor may be located on the surfaces of the oven door interior to the perimeter.

Upon determining that the oven should be cooled the process may proceed to block 340. When proceeding to block 340, the controller may cool the perimeter surfaces below a first temperature threshold, read from the perimeter surface temperature sensors, before cooling other surfaces of the door and/or oven. In this way, the surfaces of the oven more likely to be contacted by a user may be cooled first, before surfaces that are less likely to be contacted by a user.

At block 340 the controller may activate the cooling bank 116 and cooling circuits 112. In some embodiments, activating the cooling bank and cooling circuits may include opening a valve connecting the cooling bank 116 in fluid communication with the cooling circuit 112 and activating a pump to pump the fluid within the cooling bank 116 through the cooling circuit 112. In some embodiments, activating the cooling bank and cooling circuits may include providing electrical energy from the cooling bank 116 to Peltier coolers in the cooling circuits 112*a*. The cooling bank and cooling circuits may be activated until the controller determines that either the oven door is being closed or is closed or the temperature of the surfaces of the door or below a predetermined threshold or the cooling energy is depleted, such as depleted below a threshold.

The temperature threshold for cooling the door may be 110 degrees Fahrenheit. In some embodiments the temperature threshold of the oven surfaces may be cooled to a temperature threshold above 110 degrees Fahrenheit. The energy required to cool oven surfaces to 110 degrees Fahrenheit may be so high as to make it impractical to provide such cooling. In some embodiments, the temperature threshold may be 150 degrees Fahrenheit.

In some embodiments, the cooling system may be disabled.

Figure 4:
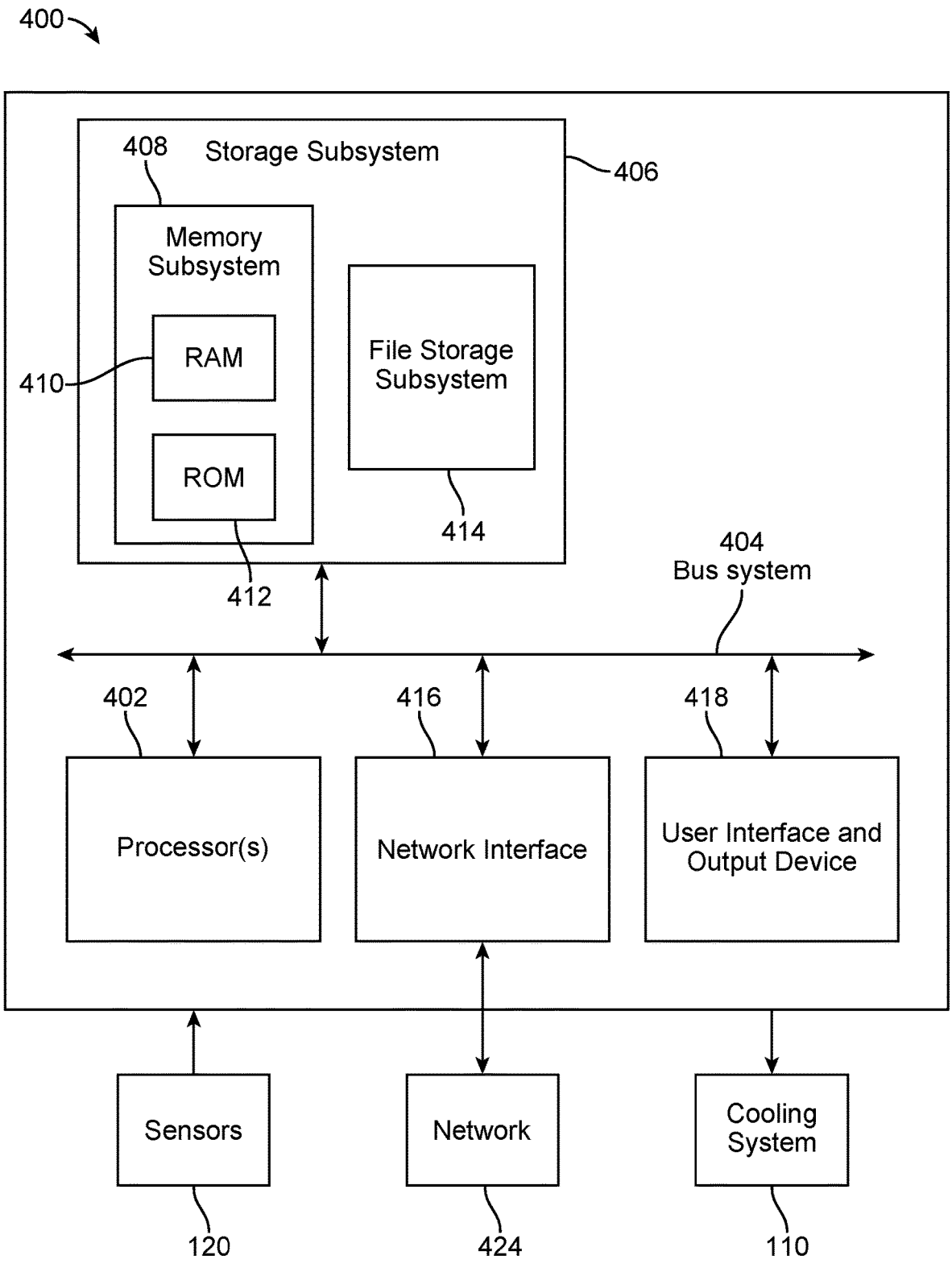
FIG. 4 shows a simplified block diagram of a data processing system, in accordance with embodiments.

FIG. 4 is a simplified block diagram of a data processing system 400 that may be used in executing methods and processes described herein. The data processing system 400 typically includes at least one processor 402 that communicates with one or more peripheral devices via bus subsystem 404. These peripheral devices typically include a storage subsystem 406 (memory subsystem 408 and file storage subsystem 414), a set of user interface input and output devices 418, and an interface to outside networks 416. This interface is shown schematically as "Network Interface" block 416 and is coupled to corresponding interface devices in other data processing systems via communication network interface 424. Data processing system 400 can include, for example, one or more computers, such as a personal computer, workstation, mainframe, laptop, and the like.

The data processing system 400 may include a portable device is wireless communication with a processor of the cooling system 110. The portable device may be a cellular device, such as a smartphone running an Android or iOS operating system and including an application for controlling the oven and the cooling functions. For example, the smartphone may enable or disable the cooling system, carry out of the method 300, and/or control the oven settings, such as set temperature and cooking type (bake, broil, etc.).

The user interface input devices 418 are not limited to any particular device, and can typically include, for example, a keyboard, pointing device, mouse, scanner, interactive displays, touchpad, joysticks, etc. Similarly, various user interface output devices can be employed in a system of the invention, and can include, for example, one or more of a printer, display (e.g., visual, non-visual) system/subsystem, controller, projection device, audio output, and the like.

Storage subsystem 406 maintains the basic required programming, including computer readable media having instructions (e.g., operating instructions, etc.), and data constructs. The program modules discussed herein are typically stored in storage subsystem 406. Storage subsystem 406 typically includes memory subsystem 408 and file storage subsystem 414. Memory subsystem 408 typically includes a number of memories (e.g., RAM 410, ROM 412, etc.) including computer readable memory for storage of fixed instructions, instructions and data during program execution, basic input/output system, etc. File storage subsystem 414 provides persistent (non-volatile) storage for program and data files, and can include one or more removable or fixed drives or media, hard disk, floppy disk, CD-ROM, DVD, optical drives, and the like. One or more of the storage systems, drives, etc. may be located at a remote location, such coupled via a server on a network or via the internet/World Wide Web. In this context, the term "bus subsystem" is used generically so as to include any mechanism for letting the various components and subsystems communicate with each other as intended and can include a variety of suitable components/systems that would be known or recognized as suitable for use therein. It will be recognized that various components of the system can be, but need not necessarily be at the same physical location, but could be connected via various local-area or wide-area network media, transmission systems, etc.

the data processing system 400 may be connected in communication with sensors 120 and the cooling system 110 as described herein.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered example in nature since many other architectures can be implemented to achieve the same functionality.

In some examples, all or a portion of example system 400 in FIG. 4 may represent portions of a cloud-computing or network-based environment. Cloud-computing environments may provide various services and applications via the Internet. These cloud-based services (e.g., software as a service, platform as a service, infrastructure as a service, etc.) may be accessible through a web browser or other remote interface. Various functions described herein may be provided through a remote desktop environment or any other cloud-based computing environment.

In various embodiments, all or a portion of example system 400 in FIG. 4 may facilitate multi-tenancy within a cloud-based computing environment. In other words, the software modules described herein may configure a computing system (e.g., a server) to facilitate multi-tenancy for one or more of the functions described herein. For example, one or more of the software modules described herein may program a server to enable two or more clients (e.g., customers) to share an application that is running on the server. A server programmed in this manner may share an application, operating system, processing system, and/or storage system among multiple customers (i.e., tenants). One or more of the modules described herein may also partition data and/or configuration information of a multi-tenant application for each customer such that one customer cannot access data and/or configuration information of another customer.

According to various embodiments, all or a portion of example system 400 in FIG. 4 may be implemented within a virtual environment. For example, the modules and/or data described herein may reside and/or execute within a virtual machine. As used herein, the term "virtual machine" generally refers to any operating system environment that is abstracted from computing hardware by a virtual machine manager (e.g., a hypervisor). Additionally or alternatively, the modules and/or data described herein may reside and/or execute within a virtualization layer. As used herein, the term "virtualization layer" generally refers to any data layer and/or application layer that overlays and/or is abstracted from an operating system environment. A virtualization layer may be managed by a software virtualization solution (e.g., a file system filter) that presents the virtualization layer as though it were part of an underlying base operating system. For example, a software virtualization solution may redirect calls that are initially directed to locations within a base file system and/or registry to locations within a virtualization layer.

In some examples, all or a portion of example system 400 in FIG. 4 may represent portions of a mobile computing environment. Mobile computing environments may be implemented by a wide range of mobile computing devices, including mobile phones, tablet computers, e-book readers, personal digital assistants, wearable computing devices (e.g., computing devices with a head-mounted display, smartwatches, etc.), and the like. In some examples, mobile computing environments may have one or more distinct features, including, for example, reliance on battery power, presenting only one foreground application at any given time, remote management features, touchscreen features, location and movement data (e.g., provided by Global Positioning Systems, gyroscopes, accelerometers, etc.), restricted platforms that restrict modifications to system-level configurations and/or that limit the ability of third-party software to inspect the behavior of other applications, controls to restrict the installation of applications (e.g., to only originate from approved application stores), etc. Various functions described herein may be provided for a mobile computing environment and/or may interact with a mobile computing environment.

In addition, all or a portion of example system 400 in FIG. 4 may represent portions of, interact with, consume data produced by, and/or produce data consumed by one or more systems for information management. As used herein, the term "information management" may refer to the protection, organization, and/or storage of data. Examples of systems for information management may include, without limitation, storage systems, backup systems, archival systems, replication systems, high availability systems, data search systems, virtualization systems, and the like.

In some embodiments, all or a portion of example system 400 in FIG. 4 may represent portions of, produce data protected by, and/or communicate with one or more systems for information security. As used herein, the term "information security" may refer to the control of access to protected data. Examples of systems for information security may include, without limitation, systems providing managed security services, data loss prevention systems, identity authentication systems, access control systems, encryption systems, policy compliance systems, intrusion detection and prevention systems, electronic discovery systems, and the like.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

While various embodiments have been described and/or illustrated herein in the context of fully functional computing systems, one or more of these example embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the example embodiments disclosed herein.

As described herein, the computing devices and systems described and/or illustrated herein broadly represent any type or form of computing device or system capable of executing computer-readable instructions, such as those contained within the modules described herein. In their most basic configuration, these computing device(s) may each comprise at least one memory device and at least one physical processor.

The term "memory" or "memory device," as used herein, generally represents any type or form of volatile or non-volatile storage device or medium capable of storing data and/or computer-readable instructions. In one example, a memory device may store, load, and/or maintain one or more of the modules described herein. Examples of memory devices comprise, without limitation, Random Access Memory (RAM), Read Only Memory (ROM), flash memory, Hard Disk Drives (HDDs), Solid-State Drives (SSDs), optical disk drives, caches, variations or combinations of one or more of the same, or any other suitable storage memory.

In addition, the term "processor" or "physical processor," as used herein, generally refers to any type or form of hardware-implemented processing unit capable of interpreting and/or executing computer-readable instructions. In one example, a physical processor may access and/or modify one or more modules stored in the above-described memory device. Examples of physical processors comprise, without limitation, microprocessors, microcontrollers, Central Processing Units (CPUs), Field-Programmable Gate Arrays (FPGAs) that implement softcore processors, Application-Specific Integrated Circuits (ASICs), portions of one or more of the same, variations or combinations of one or more of the same, or any other suitable physical processor.

Although illustrated as separate elements, the method steps described and/or illustrated herein may represent portions of a single application. In addition, in some embodiments one or more of these steps may represent or correspond to one or more software applications or programs that, when executed by a computing device, may cause the computing device to perform one or more tasks, such as the method step.

In addition, one or more of the devices described herein may transform data, physical devices, and/or representations of physical devices from one form to another. Additionally or alternatively, one or more of the modules recited herein may transform a processor, volatile memory, non-volatile memory, and/or any other portion of a physical computing device from one form of computing device to another form of computing device by executing on the computing device, storing data on the computing device, and/or otherwise interacting with the computing device.

The term "computer-readable medium," as used herein, generally refers to any form of device, carrier, or medium capable of storing or carrying computer-readable instructions. Examples of computer-readable media comprise, without limitation, transmission-type media, such as carrier waves, and non-transitory-type media, such as magnetic-storage media (e.g., hard disk drives, tape drives, and floppy disks), optical-storage media (e.g., Compact Disks (CDs), Digital Video Disks (DVDs), and BLU-RAY disks), electronic-storage media (e.g., solid-state drives and flash media), and other distribution systems.

A person of ordinary skill in the art will recognize that any process or method disclosed herein can be modified in many ways. The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed.

The various exemplary methods described and/or illustrated herein may also omit one or more of the steps described or illustrated herein or comprise additional steps in addition to those disclosed. Further, a step of any method as disclosed herein can be combined with any one or more steps of any other method as disclosed herein.

The processor as described herein can be configured to perform one or more steps of any method disclosed herein. Alternatively or in combination, the processor can be configured to combine one or more steps of one or more methods as disclosed herein.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and shall have the same meaning as the word "comprising.

The processor as disclosed herein can be configured with instructions to perform any one or more steps of any method as disclosed herein.

It will be understood that although the terms "first," "second," "third", etc. may be used herein to describe various layers, elements, components, regions or sections without referring to any particular order or sequence of events. These terms are merely used to distinguish one layer, element, component, region or section from another layer, element, component, region or section. A first layer, element, component, region or section as described herein could be referred to as a second layer, element, component, region or section without departing from the teachings of the present disclosure.

As used herein, the term "or" is used inclusively to refer items in the alternative and in combination.

As used herein, characters such as numerals refer to like elements.

Embodiments of the present disclosure have been shown and described as set forth herein and are provided by way of example only. One of ordinary skill in the art will recognize numerous adaptations, changes, variations and substitutions without departing from the scope of the present disclosure. Several alternatives and combinations of the embodiments disclosed herein may be utilized without departing from the scope of the present disclosure and the inventions disclosed herein. Therefore, the scope of the presently disclosed inventions shall be defined solely by the scope of the appended claims and the equivalents thereof.

What is claimed is:

1. An oven cooling method, comprising:

sensing a position of an oven door, wherein sensing a position of an oven door includes receiving a signal from a switch;

sensing an oven temperature, if the oven door is open;

determining that the oven temperature is above a threshold; and cooling oven surfaces if the oven temperature is above the threshold, wherein cooling the oven surfaces includes transferring energy between an energy bank and cooling elements, wherein the cooling elements are coupled to the energy bank in fluidic communication.

2. The oven cooling method of claim 1, wherein the energy bank includes a pump to pump a fluid from the energy bank to and through the cooling elements.

3. The oven cooling method of claim 2, wherein a first cooling element is located proximate the perimeter of the oven door and a second cooling element is located in the oven door interior to the first cooling element.

4. The oven cooling method of claim 3, wherein the energy bank provides fluid to the first cooling element before providing fluid to the second cooling element.

5. The oven cooling method of claim 4, wherein the first cooling element is a first cooling loop and the second cooling element is a second cooling loop.

6. An oven cooling method, comprising:

sensing a position of an oven door, wherein sensing a position of an oven door includes receiving a signal from a switch;

sensing an oven temperature, if the oven door is open;

determining that the oven temperature is above a threshold; and cooling oven surfaces if the oven temperature is above the threshold, wherein cooling the oven surfaces includes transferring energy between an energy bank and cooling elements, wherein the cooling elements are operably coupled to the energy bank in electrical communication, the energy bank is an electrical energy bank, the energy bank includes a switch to electrically connect the energy bank to the cooling elements, the cooling elements are peltier coolers, a first cooling element is located proximate the perimeter of the oven door, a second cooling element is located in the oven door interior to the first cooling element, and the energy bank is operatively configured to provide electrical energy to the first cooling element before providing electrical energy to the second cooling element.

7. A cooktop cooling system comprising:

a cooktop surface;

a heating element below an upper surface of the cooktop surface operably configured to heat a portion of the cooktop surface;

a user interface configured to turn the heating element on and off;

an energy bank; and cooling circuits between the heating element and the cooktop surface, wherein the energy bank and cooling circuits act to remove energy from the cooktop to cool the cooktop surface when the heating element is turned off, wherein the cooling circuits are coupled to the energy bank in fluidic communication.

8. The oven cooling system of claim 7, wherein the energy bank stores cooling fluid.

9. The oven cooling system of claim 8, wherein the energy bank includes a pump to pump the fluid from the energy bank to and through the cooling circuits.

10. The oven cooling system of claim 9, wherein the cooling circuits are cavities in the cooktop surface.

11. The oven cooling system of claim 9, wherein the cooling circuits are channels.

12. The oven cooling system of claim 9, wherein the cooling circuits receive the fluid from the energy bank and return the fluid to the energy bank in a loop.

13. An oven cooling system comprising:

a cooktop surface;

a heating element below an upper surface of the cooktop surface operably configured to heat a portion of the cooktop surface;

a user interface configured to turn the heating element on and off;

an energy bank;

cooling circuits between the heating element and the cooktop surface, wherein the energy bank and cooling circuits act to remove energy from the cooktop to cool the cooktop surface when the heating element is turned off;

a body having an oven cavity;

a heating element operably configured to heat the oven cavity;

a door coupled to the body and operably configured to open and close; and second cooling circuits in the oven and coupled to the energy bank, wherein the energy bank is configured to remove heat from the oven cavity to cool the oven.

14. The oven cooling system of claim 13, wherein the second cooling circuits are coupled to the energy bank in fluidic communication.

15. The oven cooling system of claim 14, wherein the energy bank stores cooling fluid.

* * * * *